United States Patent [19]

Eagar

[11] Patent Number: 4,858,786

[45] Date of Patent: Aug. 22, 1989

[54] BEVERAGE CONTAINER POSSESSING AN IMPROVED SUPPORT PLATE TO EFFECT MORE RAPID CARBONATION

[76] Inventor: Lee J. Eagar, P.O. Box 622, La Verkin, Utah 84745

[21] Appl. No.: 164,328

[22] Filed: Mar. 4, 1988

[51] Int. Cl.[4] ..... B67D 5/38

[52] U.S. Cl. ..... 222/158; 222/189; 99/316

[58] Field of Search ..... 99/316–318; 222/146.6, 157–158, 189–190, 478, 481

[56] References Cited

U.S. PATENT DOCUMENTS

| | | | |
|---|---|---|---|
| 291,857 | 1/1884 | Welling | 222/189 |
| 451,862 | 5/1891 | Moncrieff | 222/189 X |
| 1,233,482 | 7/1917 | Kaletay | 222/158 |
| 2,477,998 | 8/1949 | McCowan | 222/189 X |
| 2,792,941 | 5/1957 | Groen, Jr. | 222/189 X |
| 4,170,320 | 10/1979 | Eagar | 222/146.6 X |
| 4,666,682 | 5/1987 | Mayer et al. | 422/266 |

FOREIGN PATENT DOCUMENTS

| | | | |
|---|---|---|---|
| 2399 | of 1884 | United Kingdom | 99/317 |
| 24206 | of 1904 | United Kingdom | 99/316 |

*Primary Examiner*—Michael S. Huppert

[57] ABSTRACT

This invention relates to an improved beverage container which permits one to effect a rapid carbonation of the liquid content with dry ice without excessive gas pressure build up. The new container comprises an outer housing shell having an opening at the top equipped with a lid, a water-level mark on the outside near the top and a fluid-flow release valve extending through an opening in the housing near the bottom, and a removable support plate resting near but above the bottom of the housing and extending over the internal terminal of the release valve, the support plate holding the solid dry ice which is added to the container.

5 Claims, 3 Drawing Sheets

BEVERAGE CONTAINER POSSESSING AN IMPROVED SUPPORT PLATE TO EFFECT MORE RAPID CARBONATION

BACKGROUND OF THE INVENTION

1. Field of the Invention

This invention relates to beverage containers, and more particularly to new and improved beverage containers for carbonated drinks which avoids many of the difficulties associated with prior known containers.

Specifically, the invention provides a new and improved beverage container for carbonated drinks which permits rapid carbonation without excessive gas pressure build up and freezing of the dispensing means, and which can be easily manufactured by blow or injection molding techniques. The new containers broadly comprise in combination, an outer housing shell having an opening at the top, a water level mark on the outside near the top of the housing and a fluid-flow release valve extending through an opening in the side near the bottom of said housing, a removable support plate resting on an interior ledge of the housing near but above the bottom of the housing and extending over the internal terminal of the said release valve, said support plate being adapted to holding solid cooling means added to the container, and a lid for the container having an annular side flange and a top wall integral therewith, the interior side of the flange being adapted to being removably engaged with the top of the housing.

The invention further provides a process for making carbonated beverages using the above-noted improved beverage container which broadly comprises adding the desired amount of dry ice or other cooling means to the interior of the container so that it rests on the interior support plate, adding the desired drink ingredients for the beverage to be prepared to the interior of the container, adding sufficient water so that it comes up to the water level mark on the outside of the container, placing the lid on the container, and then after a short time removing the desired carbonated beverage by means of the fluid flow release valve as the beverage is needed.

2. Prior Art

The present invention is an improvement over the inventor's prior U.S. Pat. No. 3,910,461 and U.S. No. 4,170,320. Other patents in the field of container structures include among others, the following: U.S. Pat. No. 235,044, U.S. Pat. No. 1,187,002, U.S. Pat. No. 1,778,248, U.S. Pat. No. 1,874,091, U.S. Pat. No. 1,987,323, U.S. Pat. No. 2,096,088, U.S. Pat. No. 2,105,339 and U.S. Pat. No. 2,285,096.

The prior known beverage containers possess several disadvantages which have placed limitations on their use. Some of the containers, for example, permit excessive pressure build up which may be dangerous to the operators. Other containers require extensive waiting periods before the desired carbonation takes place. Other become inoperative after a short period of use because of the condensing or freezing around the dispersing means or pressure release means. Others are expensive to manufacture and maintain which prevents their commercial use on a large scale.

It is an object of the invention, therefore, to provide a new and improved beverage container which can be used to prepare carbonated drinks. It is a further object to provide new carbonated beverage containers which avoid excessive pressure build up and are safe to operate. It is a further object to provide new and improved beverage containers which provide almost immediate formation of the carbonated beverage and avoids long waiting periods. It is a further object to provide a new beverage container which avoids condensation or freezing around the dispersing and pressure release means and permits extended periods of use without maintenance. It is a further object to provide new beverage containers which can be prepared by blow molding techniques and thus can be economically produced. These and other objects of the invention will be apparent from the following detailed description thereof.

SUMMARY OF THE INVENTION

It has now been discovered that these and other objects of the invention can be accomplished by the new beverage containers of the present invention which present for the first time an economically produced beverage container which can be safely and efficiently used for the preparation of carbonated beverages over an extended period of time without maintenance.

The new containers of the present invention broadly comprise in combination, an outer housing shell having an opening at the top, a water level mark on the side near the top of the housing and a fluid-flow release valve extending through an opening in the side near the bottom of the said housing, a removable support plate resting on an interior ledge of the housing near but above the bottom of the housing and extending over the interior terminal of the said release valve, said support plate being adapted to holding solid cooling means added to the container, and a lid for the container having an annular side flange and a top wall integral therewith, the interior side of the flange being adapted to being removably engaged with the top of the housing.

The invention further provides a process for making carbonated beverages using the above-noted improved beverage containers which broadly comprises adding the desired amount of dry ice or other cooling means to the interior of the container so that it rests on the interior support plate and preferably fills only small part of the interior of said housing, adding the desired drink ingredients for the beverage to be prepared to the interior of the container, adding sufficient water to bring the contents of the container up to the water level mark on the outside of the container, placing the lid on the container, and then after a short time removing the desired carbonated beverage from the container through the fluid flow release valve.

It has been found that the above-described beverage container provides for the first time an economically produced container which can be safely and efficiently used for the preparation of carbonated beverages. It has been found for example, unexpectedly that the use of the novel containers with the special removable support plate as noted above permits one to prepare the carbonated drinks without the danger of condensation or freezing of the dispersing means or the pressure control means. It has been found, for example, that the gases and vapors rising from the carbonation process pass up and outside through the vent holes in the lid. As the vapors do not pass over the cooling means maintained at the bottom of the support plate there is no danger of the condensation or freezing of the dispersing means or pressure control means which with prior containers gradually occur and caused the carbonation containers to be inoperative.

BRIEF DESCRIPTION OF THE DRAWINGS

Referring now to FIG. 1, the beverage container comprises a housing shell 11, lid 12, support plate 13 resting on ledge 17, fluid flow valve 13A with release button 14 and being joined to the outside of the housing by nut 15 and the support plate 13 being attached to the back of the valve in the interior by nut 31. The opening in the housing for the valve is 13B.

FIG. 2 illustrates a preferred form of the support plate 13 with perforations 18, tongue 16, hinge 19 and aperture 20 which permits the support plate to rest over the internal end of the fluid flow valve.

FIG. 3 illustrates another preferred form of the support plate shown as 32 which is made up of a flexible plastic rim 3 with plastic strips 33 woven across and attached to the rim, opening 34 which permits one to place a nut over the end of the fluid flow valve inside of the housing with the opening for said fluid flow vale as 35. The series of square or rectangular openings is represented by 33A.

FIG. 4 which is a cut through the bottom of the housing along line 3 illustrates the location of the internal ledge of the housing 17, the placing of the support 13 on said ledge, the placing of the hinged part of the support plate over the terminal end of the fluid flow valve 29, the opening in the housing 13B for the said valve, lock nut 21 holding the support plate in place against the inside of the housing, lock nut 15 on the outside to hold the valve 14A against the side of the housing, and the release button 14 to effect release of the fluid.

FIG. 5 which is a cut through the top of the housing along line 3 illustrates the preferred form of the lid 12, handle 15A, top 42, side flange 23 adapted to being threadly engaged to the top of the housing through threading 25 on the side flange and threading 24 on the housing, with vent orifice 28, and water-line indicator 26.

FIG. 6 which is another through the top of the housing illustrates another preferred form of the lid 12, handle 15A, top 42, side flange 23 adapted to being threadedly engaged to the top of the housing through threading 25 on the side flange and threading 24 on the housing, with added cap 37 as an inverse cup attached to the bottom of the top line through screw 38, with the water line indicator as 26. The vent orifices in the top of the lid are shown as 28.

DETAILED DESCRIPTION OF THE INVENTION

Figure 1:
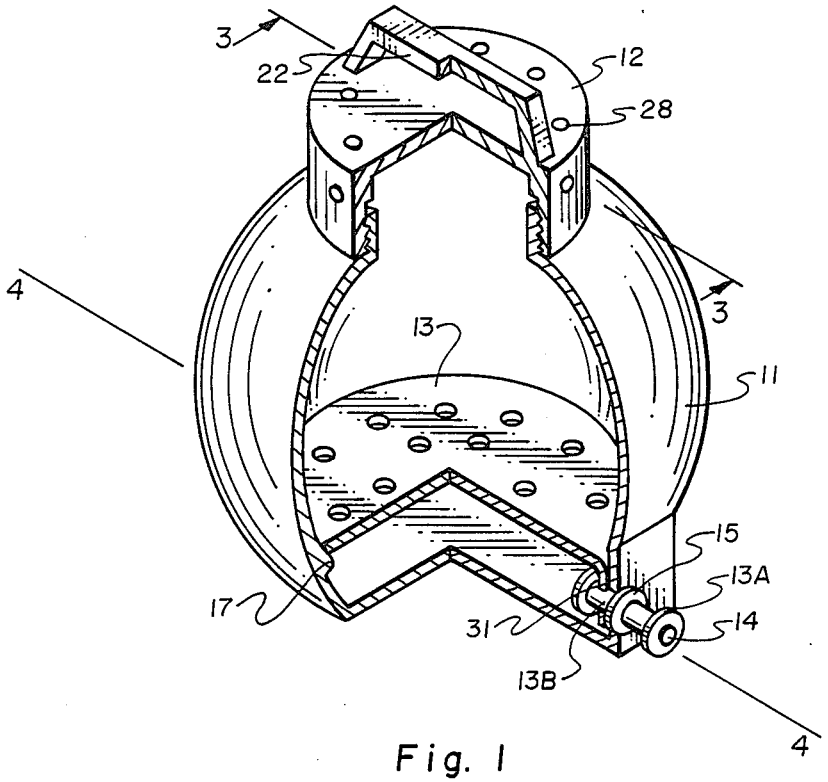
FIG. 1 is a perspective view, partially broken away, of a beverage container constructed in accordance with the preferred principles of the present invention.

The new beverage containers of the present invention will now be described in detail with particular reference to the preferred containers shown in the drawings.

The outer housing shell 11 can be constructed of any shape and size depending upon the desired use as long as it provides the necessary opening with means for securing a lid thereto, the support plate maintained above the bottom of said housing and a valve means for removing the carbonated liquid when prepared. Preferably the housing shell is of annular shape as shown in the drawing and is generally from about 12 to 18 inches in height. The housing shell is preferably prepared by blow molding using conventional plastics, such as polyvinyl chloride, polyethylene, polycarbonates, polyacrylates, polyethylene, polybutylene and the like, and mixtures thereof.

The support plate to be placed near but above the bottom of the housing to support the cooling means may be of any shape or size. Generally the plate is of the shape of the housing shell at that point so as to follow the contour of the housing and prevent any spilling of the cooling means, such as the dry ice, from falling down onto the bottom of the housing.

Figure 2:
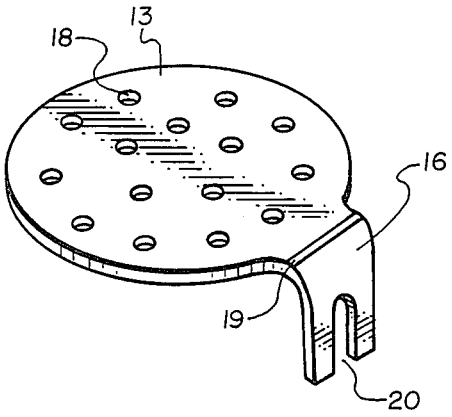
FIG. 2 is a top view of one of the preferred forms of the support plate.
Figure 3:
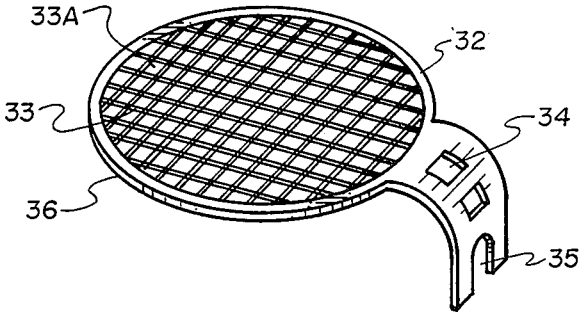
FIG. 3 is a top view of another preferred form of a support plate having a different arrangement of the holes in said plate.

The support plate may be of one piece as 32 in FIG. 3, or it may be hinged as shown in FIG. 2 with the hinge 19 connecting the main part of the plate to the tongue 16 which possesses the opening to fit over the release valve. The plate having the hinge is generally preferred as it greatly facilitates removal of the plate from the interior of the housing shell.

The support plate is preferably perforated in any desirable manner to permit liquid to pass down through the perforations. The perforations can be merely a series of openings 18 as shown in FIG. 2, or they can appear as a woven set of openings 33A as shown in FIG. 3. In general, such openings or perforations may be of any configuration, but is preferably circular, square or rectangle in size. In most cases, the openings may vary from about 1/4 to 1/2 in diameter in the event the openings are annular, or 1/4 to 1 inch in length in the event the openings are square or rectangular.

The support plate can be prepared from any suitable material, but is preferably prepared from a flexible plastic material, such as polyvinyl chloride, polyethylene, polypropylene, and the like, so that it can be easily bent and placed down in and out of the housing shell.

The support plate is placed near but above the bottom of the housing so that it substantially covers the bottom of the housing and extends over the top of the release valve. Preferably the plate is placed from about 1 to 2 inches above the bottom of the housing and can be maintain in this position by any suitable means, such as legs, ledges, and the like. As noted in the drawings, the preferred method for sustaining the plate is to have a small ledge formed all or partially around the inside of the housing near the bottom of the housing so that the the edges of the plate can rest on the top of the ledge. Such ledge preferably extends out into the interior of the housing about 1/8 to 1/4 inch and is either continuous or in segments around the interior wall of the housing.

As shown in the drawing, the support plate extends over the top of the release valve. This is to prevent any of the cooling means from dropping around the release valve and interfere with the operation by freezing or otherwise causing the release valve to be inoperative.

As the support plate extends over the top of the release valve it is preferably bend down over the said release valve as shown in the drawings such as 20 in FIG. 2 and 35 in FIG. 3 so that the plate can extend over both sides of the valve. As shown in FIG. 1, connecting means, such as nut 15, can be used to hold the bent down portion firmly against the inside of the housing and around the release valve.

In operation, the support plate can be easily removed for cleaning or other purposes. If the plate possesses a hinge as in FIG. 2, the plate can be bent upwards, the nut removed and the plate then lifted out through the opening at the top. If the plate is made of plastic woven material as in FIG. 3, the connecting means nut can be removed by use of the opening 34, the plate then pressed together and then pulled up through the opening in the housing.

The water level mark on the outside of the housing as shown as 26 in FIGS. 5 and 6, can be placed in any suitable place, but is preferably about 2 to 5 inches below the top of the housing shell such as those having a 2 to 3 gallon content. This space is needed for collection of vapors given off during the operation.

While not essential, it is sometimes desirable to have a conventional pressure release valve near the top of the housing as a safety valve in the event that excessive pressure is built up in the interior of the housing.

Figure 4:
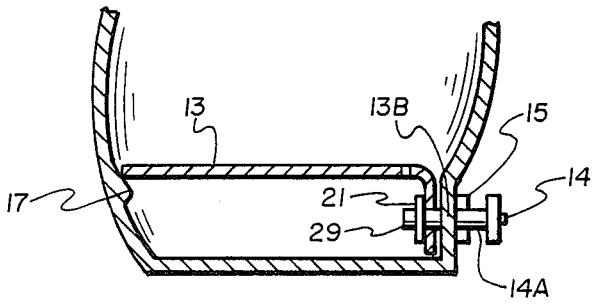
FIG. 4 is a side view of a cut through the bottom of the housing along line 4 showing how the support plate rests on the ledge of the housing near but above the bottom of the housing, and how it is over but removably connected to the interior end of the fluid flow valve.

The fluid flow valve shown as 13A in FIG. 1 and 14A in FIG. 4, can be of any shape or size and may take any one of several forms shown in connection with current water jugs and the like. Such a valve is mounted in opening 13B in the housing shell. The valve is preferably mounted close to the bottom of the housing shell so as to permit almost complete drainage of the housing. As shown in FIG. 4, the valve is preferably held in the opening in the housing by means of connecting means such as nuts 21 and 15. The valve is operated by pressing the release button 14 to remove the carbonated liquid and removing the pressure on the button to close the valve.

The lid for the container can also be of various sizes and structure as long as it possesses the essential features of having means for being securely attached to the top of the housing, and preferably having vent means for release of excess pressure.

Figure 5:
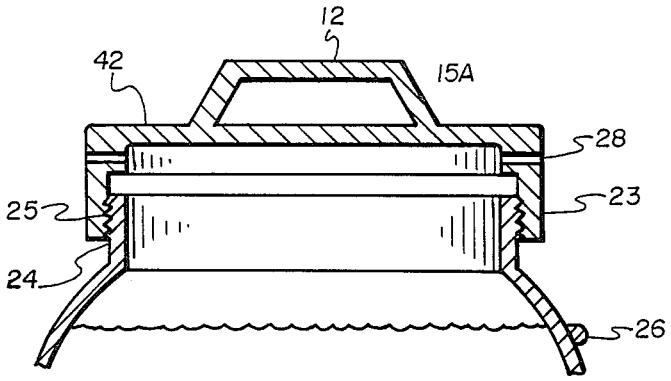
FIG. 5 is a side view of a cut through the top of the housing along line 3 showing the construction of one of the preferred lids and how it is placed on top of the housing.

The lid is preferably removable secured to the top of the housing by thread means as shown in FIG. 5 with the threaded portion of the housing as 24 and the threaded portion of the lid as 25.

As noted, the lid preferably contains vent holes to release gas and thus avoid excessive pressure build up. The vent holes may preferably vary from about 1/16 to 1/4 inch in diameter, and more preferably about 1/8 inches in diameter. If the vent holes are large they preferably contain some restriction to avoid too rapid removal, while the very small vent holes do not need such a restriction.

The vent holes in the lid are preferably arranged so as to provide optimum venting of the vapors. The number of the holes preferably vary from about 3 to 12, and are preferably arranged in equal distances apart or other suitable arrangement. They may be located either in the side of the top as shown by 28 in FIG. 5 or they may be located in the top of the lid as shown by 28 in FIG. 1.

Figure 6:
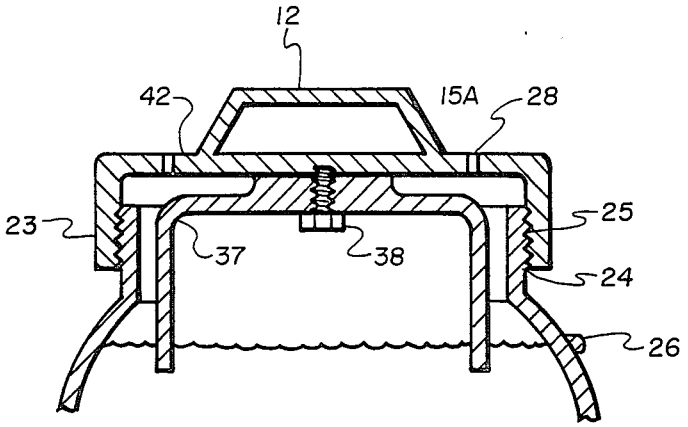
FIG. 6 is a side view of a cut through the top of the housing showing the construction of another preferred lid which has a cap attached at the bottom so as to facilitate the passage of the vapors and gas up and out of the holes in the top of the lid.

To assist in removal of the vapors, it is sometimes desirable to have a cap attached to the bottom of the lid as shown in FIG. 6. The cap 37 is attached to the bottom of the lid top 42 by means of screw 38. The walls of the cap extend downwardly to at least the water level as shown in that Figure. To insure a good seal, it is preferred to extend the walls a distance past the water line, e.g. about 1/8 to 1/2 inch past the line.

The passage way between the wall of the cap and the side of the housing top should be sufficient to permit passage of the vapors to the top of the lid and out the vents shown as 28 in FIG. 6. In general, the passage way should be at least 1/8 inch in width and preferably from about 1/8 to 1/2 inch in width.

The lid can be prepared in any suitable manner, but is preferably prepared by injection molding using any of the abovedescribed plastic materials.

The beverage containers of the present invention may be used for the preparing of a variety of different carbonated drinks and can be used for an extended period of time without freezing of the dispersing or venting means.

The containers are preferably employed in the following manner. The desired amount of dry ice is added to the interior of the container and placed on the support plate at the bottom of the container. The desired drink ingredients for the beverage to be prepared are added to the container in the requirement amounts and water then added to bring the contents of the container at least the water mark shown on the outside of the housing shell. The lid is then placed on the container and after a short time, e.g. 10 minutes, the carbonated beverage can then be removed from the container through the fluid flow release valve.

PREFERRED EMBODIMENT OF THE INVENTION

A preferred embodiment of the invention is described below. It should be understood, however, that this is given as a preferred assembly for illustration purposes only and is not to be regarded as limiting the invention in any way.

A 3 gallon round housing as shown in FIG. 1 was prepared by blow molding using poly(vinyl chloride) as the plastic material. The interior of the housing possessed a slight ledge of about 1/4 in width almost completely around the said interior about 1 1/2 inch above the bottom of the housing. A plastic support plate about 1/16 inches in thickness was prepared from plastic woven sheeting as shown in FIG. 3. The openings in the plate were about 1/2 ×3/4 inches and were spaced about 1/8 inches apart. The plate was highly flexible and could be bent and placed down in the housing so as to rest on the ledge and cover over the top of the fluid flow release valve. The plate was retain in position by nuts threaded around the interior and outside portion of the fluid release valve.

The opening at the top of the housing was about 5 1/2 inches in diameter and was covered by a lid as shown in FIG. 5. The lid prepared from molded poly(vinyl chloride) possessed four vent holes of about 1/8 inches in diameter near the top and at both sides of the lid.

The water line on the outside of the housing top was about 3 inches below the top of the housing.

In operation, dry ice chips were placed in the housing on top of the support plate to cover said plate and extend about 2 to 3 inches above the bottom of the plate. The ingredients for root beer include the extract and sugar was then placed in the housing and water added to bring the water level to the mark indicated on the outside of the housing. The lid was then placed on the container and the mixture allowed to carbonate. After a short period, the beverage was ready and could be removed through the fluid flow release valve. The container was utilized for several hours and during that time the container was completely free of any freezing of the dispersing means and any excessive vapor build up.

I claim as my invention:

1. A beverage container comprising in combination an outer housing shell having an opening at the top, a water level mark on the side near the top of the housing and a fluid-flow release valve extending through an opening near the bottom side of the said housing, a removable support plate resting near but above the bottom of the said housing and possessing a tongue hinged onto said plate with the tongue extending over the interior end of the fluid flow valve and being bent down and around said fluid-flow valve, and said support plate being adapted for holding solid cooling means to be added to the container, a lid for the container having a side flange and a top wall integral therewith, the interior side of the flange being adapted to being removably engaged with the top of the housing, and vent means in said lid to permit removal of any vapors formed inside the housing.

2. A container as in claim 1 wherein the lid has attached to the bottom side of the top wall of said lid an open-ended cap the wall of which extends downwardly leaving an open channel passage way between said cap wall and the side flange and said cap wall extending downwardly to at least the level of the water mark on the side of the housing, and wherein the vent means in said lid connect the open channel passage with the air on the outside of the lid.

3. A container as in claim 1 wherein the support plate is perforated and flat.

4. A container as in claim 1 wherein the support plate rests on a ledge container on the inside surface of the housing about 1 to 3 inches from the bottom of the housing shell.

5. A container as in claim 1 wherein the support plate contains a plurality of holes and is dished.

* * * * *